US006755183B2

(12) United States Patent
Frech et al.

(10) Patent No.: US 6,755,183 B2
(45) Date of Patent: Jun. 29, 2004

(54) METHOD AND ARRANGEMENT FOR OPERATING AN INTERNAL COMBUSTION ENGINE

(75) Inventors: Eberhard Frech, Kirchheim (DE); Wolfgang Wagner, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 10/274,129

(22) Filed: Oct. 21, 2002

(65) Prior Publication Data

US 2003/0075155 A1 Apr. 24, 2003

(30) Foreign Application Priority Data

Oct. 20, 2001 (DE) ..... 101 52 236

(51) Int. Cl.[7] ..... F02M 51/00
(52) U.S. Cl. ..... 123/491; 123/478; 123/527
(58) Field of Search ..... 123/491, 179.16, 123/457, 478

(56) References Cited

U.S. PATENT DOCUMENTS

| | | | | | |
|---|---|---|---|---|---|
| 3,557,765 | A | * | 1/1971 | Nystrom | 123/387 |
| 4,351,283 | A | * | 9/1982 | Ament | 123/458 |
| 4,567,872 | A | * | 2/1986 | Roosa | 123/470 |
| 4,770,141 | A | * | 9/1988 | Bonin | 123/385 |
| 5,564,406 | A | | 10/1996 | Klein | |
| 5,722,363 | A | * | 3/1998 | Iida et al. | 123/305 |

FOREIGN PATENT DOCUMENTS

| | | |
|---|---|---|
| DE | 199 34 357 | 1/2001 |
| EP | 0 886 058 | 12/1998 |

* cited by examiner

*Primary Examiner*—John Kwon
(74) *Attorney, Agent, or Firm*—Walter Ottesen

(57) ABSTRACT

The invention is directed to a method and an arrangement for operating an internal combustion engine wherein the vapor pressure curve is determined with a pressure sensor in the fuel metering pipe during the shutoff phase of the engine and the fuel injection quantity in a subsequent start of the engine is corrected in correspondence to this pressure curve.

11 Claims, 3 Drawing Sheets

METHOD AND ARRANGEMENT FOR OPERATING AN INTERNAL COMBUSTION ENGINE

BACKGROUND OF THE INVENTION

Fuels distinguish one from the other with respect to their behavior as to volatility. Low volatile fuels having a low vapor pressure require an additional quantity of metered fuel especially as long as the engine has not yet reached its operating point. In some applications, the enrichment, which is needed for a cold start with low-volatile fuel compared to more volatile fuel, is up to 40%.

From U.S. Pat. No. 5,564,406, it is known to correct the fuel quantity to be injected in dependence upon the fuel quality. The fuel quality is derived from the behavior of the lambda control in the start phase.

A condition precedent for the adaptation of the fuel injection quantity in the known solution is therefore an operational ready lambda control. However, this is not immediately present at the start of the engine so that the detection of the fuel quality or the fuel characteristics is at least incomplete for some applications and primarily because the adaptation of the injection quantity is of special significance during the start phase. Furthermore, the fuel quality or the fuel characteristics are only indirectly detected so that statements as to the accuracy of the adaptation can be made only with difficulty.

For example, from U.S. Pat. No. 6,513,501, it is known to use a vapor filled fuel-pressure attenuator which is elastically deformable and which is utilized in a fuel distributor pipe of an internal combustion engine.

SUMMARY OF THE INVENTION

The method of the invention is for operating an internal combustion engine having a fuel distributor. The method includes the steps of: determining the pressure in the fuel distributor after the engine is shut off; and, determining a signal quantity for fuel metering to the engine in the next operating cycle thereof in dependence upon the pressure.

With the direct detection of the thermodynamic characteristics of the fuel, a precise, reliable and rapid determination of the fuel quality or the fuel characteristics is provided. This leads also to a satisfactory accuracy of the correction of the fuel injection quantity (here, injection quantity is understood hereinafter also to be the fuel mass which is to be injected).

It is of special advantage that the air/fuel ratio can be adjusted with greater accuracy so that the emission of toxic substances is reduced and the driving performance is improved. This advantage becomes especially evident in a cold start.

It is specially advantageous to measure the vapor pressure curve of the fuel during the shutoff phase in the fuel rail or fuel distributor with a pressure sensor in the metering pipe and to correct the injection quantity during the subsequent operating cycle of the engine in correspondence to this vapor pressure information. In an especially advantageous manner, the fuel quantity is therefore corrected also during the phases wherein it is still open-loop controlled and is not closed-loop controlled by means of a lambda control. This is especially important for the cold start and the warm up of the engine. Modern exhaust-gas requirements are therefore satisfied.

It is especially advantageous when the pressure sensor in the metering pipe is a pressure sensor which is utilized in the distributor pipe in the context of the electric control of the fuel pressure.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
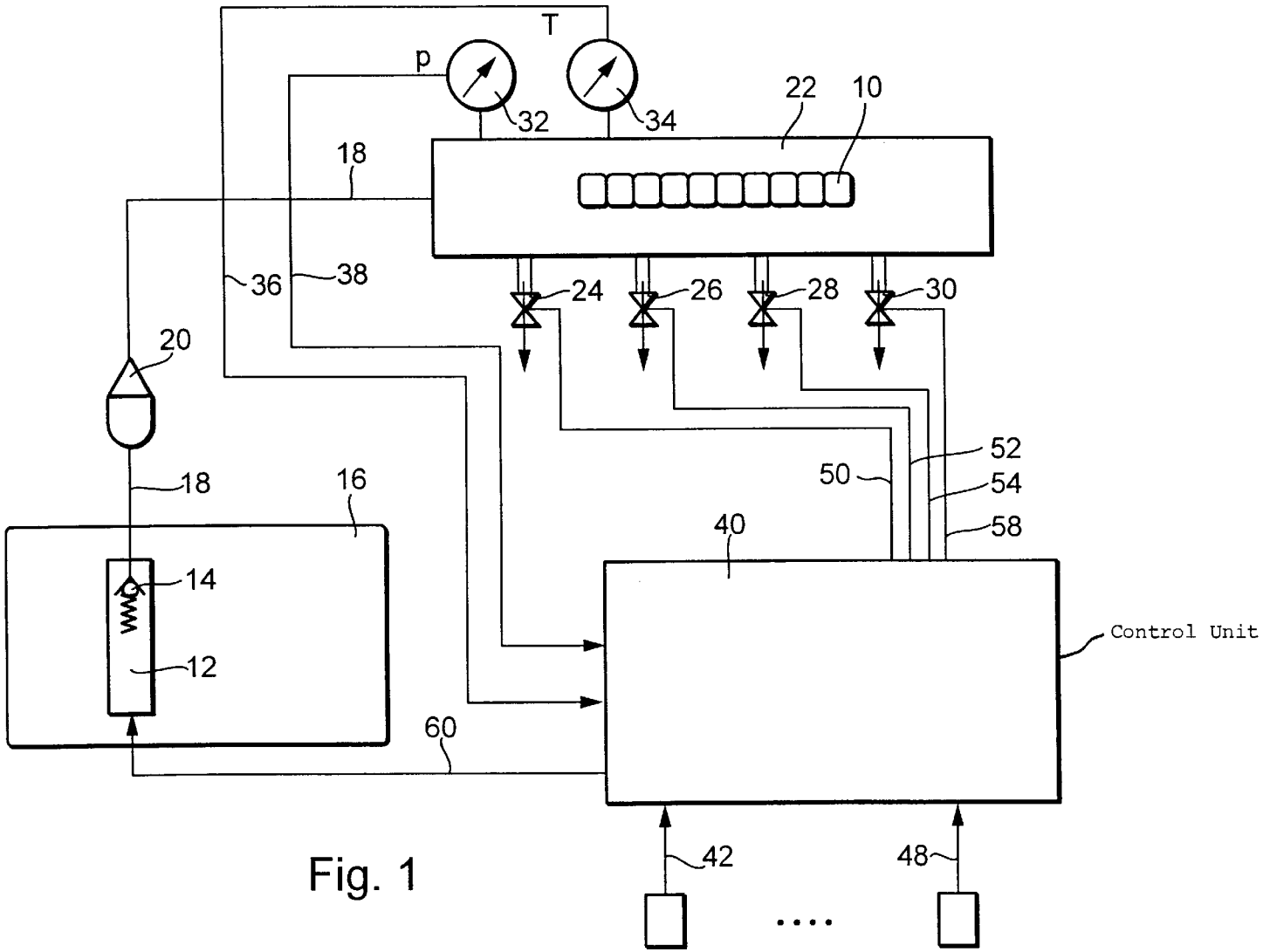
FIG. 1 is an overview block diagram of an internal combustion engine having an electronic control apparatus with such elements being shown which are essential with the view toward the procedure which is described hereinafter.

FIG. 1 shows an overview block diagram of a fuel injection system. A fuel loop is shown having a vapor pressure attenuator in a fuel distributor pipe 22 which is filled with gas, preferably with propane. This fuel pressure attenuator is identified by reference numeral 10. Furthermore, a fuel pump 12 is provided which has a check valve 14. Fuel pump and check valve are built into a tank 16. A fuel supply line 18 leads from the output end of the pump via a fuel filter 20 to the fuel distributor pipe 22. The injection valves 24, 26, 28 and 30 are supplied with fuel by the fuel distributor pipe 22. Furthermore, a sensor 32 is provided which measures the pressure P in the distributor pipe 22. In one embodiment, a temperature sensor 34 is provided which measures the fuel temperature in the distributor pipe. The two measured signal quantities are supplied via electrical lines 36 and 38 to an electronic control apparatus 40. This electronic control apparatus 40 receives additional operating variables of the engine and/or of the vehicle via additional input lines 42 to 48. These operating variables are evaluated for carrying out engine control functions. The control unit 40 transmits drive signals for the injection valves via output lines 50, 52, 54 and 58. The injection valves effect the metering of a desired fuel quantity. The control unit 40 controls the electric fuel pump 12 via a further output line 60 and preferably in the context of a closed loop control of the pressure in the fuel distribution pipe.

As will be explained hereinafter, the fuel quality or its volatility characteristic is determined by measuring the thermodynamic characteristics of the fuel. A corrective factor for the injection quantity is computed from a vapor pressure curve in dependence upon the determined volatility characteristic. This vapor pressure curve is measured during the shutoff phase of the engine with the aid of a pressure sensor in the metering pipe and the injection quantity in the subsequent start operation is corrected in correspondence to this vapor pressure information. The electronic control unit remains active in the shutoff phase of the engine at least as long as the determination of the vapor pressure curve takes place.

The pressure in the fuel distributor is reduced below the saturation vapor pressure of the fuel for the measurement of the curve. The pressure, and if necessary, the temperature in the fuel distributor are measured during the cooling off of the fuel and are stored in the control unit, namely, in a memory of the microcomputer present in the control unit. From the stored data, the vapor pressure curve of the fuel is determined (in dependence upon the temperature of the fuel when a temperature sensor is provided) and is used to correct the fuel quantity to be injected.

Accordingly, to measure the vapor pressure, the pressure in the fuel distributor is to be reduced below the saturation vapor pressure of the fuel. For this purpose, various possibilities are available which are used depending upon the embodiment:

(a) a first possibility is that the fuel pump is driven in reverse and the fuel volume is drawn by suction from the fuel distributor;

(b) a second possibility is switching in an underpressure store which is mounted on the fuel distributor or on the fuel feed lines in a manner similar to the use of the storage of intake manifold pressure for servo systems;

(c) a third possibility is opening the injection valves as long as an underpressure in the intake manifold or in the cylinders is present;

(d) a fourth possibility is the use of an expansion element which increases the volume of the fuel distributor when cooling, for example, a bimetal device which is heated by the cooling water and increases the volume of the fuel distributor when cooling down; and, (e) a last possibility is defined by the pressure attenuators built into the fuel distributor and which are built in as elastic thin-walled metal tubes. These vapor attenuators can, for example, be filled with propane or a comparable gas whose volume is sufficiently dependent upon temperature. The inner pressure changes then from 6 bar at 0° C. to 20 bar at 60° C. Because of the gas pressure, the pressure attenuator expands when warming or reduces its volume when cooling down.

One of the above-mentioned possibilities for reducing the pressure in the fuel distributor is used when switching off the engine depending upon the configuration of the fuel system and depending upon the application.

In an advantageous embodiment, the temperature in the fuel distributor is additionally considered. In the preferred embodiment, this temperature is measured with a temperature sensor which detects the temperature of the fuel in the fuel distributor. If such a temperature sensor is not available, then the temperature is computed from temperature information already available in the control apparatus, for example, in dependence upon the cooling water temperature, the load, the rpm, the duration of operation and/or the air mass. The fuel temperature, as a rule, increases with the cooling water temperature while it drops with higher load and higher rpm because the fuel flow is increased in these operating states.

A model for the vapor pressure curve of the fuel is used in the electronic control unit. The parameters of this model are determined from the measured values of the vapor pressure during the shutoff phase in dependence upon the temperature after shutting off the engine. In an advantageous embodiment, it has been shown that the use of the vapor pressure equation of Antoine is suitable to define such a model for computing the saturation vapor pressure Ps. The equation is as follows:

$$lnPs=A-B/(C+T).$$

The parameters A, B and C are substance constants and are determined from the measured values of the vapor pressure and the temperature T in accordance with the method of least error squares.

The use of other vapor pressure equations is provided for in other embodiments (for example, the vapor pressure curve of Riedel, of Riedel-Plank-Miller, of Thek-Stiel, et cetera). In a first approximation, there are useful numerical values when using the values for ethanol.

Figure 3:
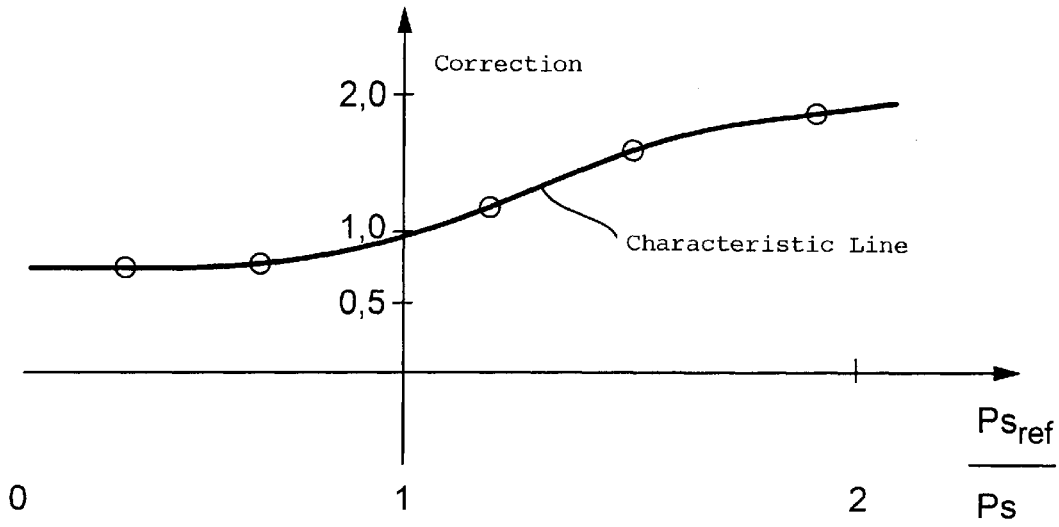

In this way, the saturation vapor pressure of the fuel used is determined. The correction of the fuel quantity, which is to be injected, takes place at the particular temperature in the fuel distributor with the aid of the ratio of the saturation vapor pressure PSREF of a reference fuel (which is used for the adaptation) to the vapor pressure of the fuel used, which could be determined, for example, from the vapor pressure measurement in accordance with the above model, namely:

$$TIcorr=TI\times\text{characteristic line }(PSREF/PS)$$

wherein: TI is the injection time which is determined on the basis of operating variables such as rpm and the supplied fuel mass. The characteristic line wherein corrective values are stored in dependence upon the ratio PSREF/PS, has parameters which can be calibrated. The correction takes place only when the engine is cold. The values of the characteristic line are determined from starting attempts utilizing least volatile fuel. In one embodiment, the correction of the injection time is controlled as a function of time, for example, after 20 seconds, preferably linearly, the value 1.0 is reached as a corrective value. An example for the corrective characteristic line is shown in FIG. 3.

In another specific embodiment, a fuel distributor is utilized with a vapor attenuator which is filled with propane. After switching off the engine, the fuel distributor cools, for example, from 80° C. down to 10° C. The elastic pressure attenuator reduces its volume because of the pressure drop of the propane in the pressure attenuator. The check valve in the fuel pump is so configured that it only opens with a pumping action of the fuel pump. In this way, the saturation vapor pressure of the fuel adjusts in the fuel distributor. The temperature and the vapor pressure values are stored in the control apparatus. A curve of the pressure values as a function of temperature results. From these values, the parameters of the vapor pressure model are determined. In a restart of the engine, the fuel quantity, which is to be injected, is corrected in the ratio of the vapor pressure of the reference fuel to the model vapor pressure. In this way, a precise consideration of the fuel quality or of the fuel characteristics is already possible at the beginning of the start phase.

The described procedure for the determination of the saturation pressure is carried out in one embodiment as a program of a microcomputer which is part of the electronic control unit 40. An example of such a program is shown with the flowchart of FIG. 2.

Figure 2:
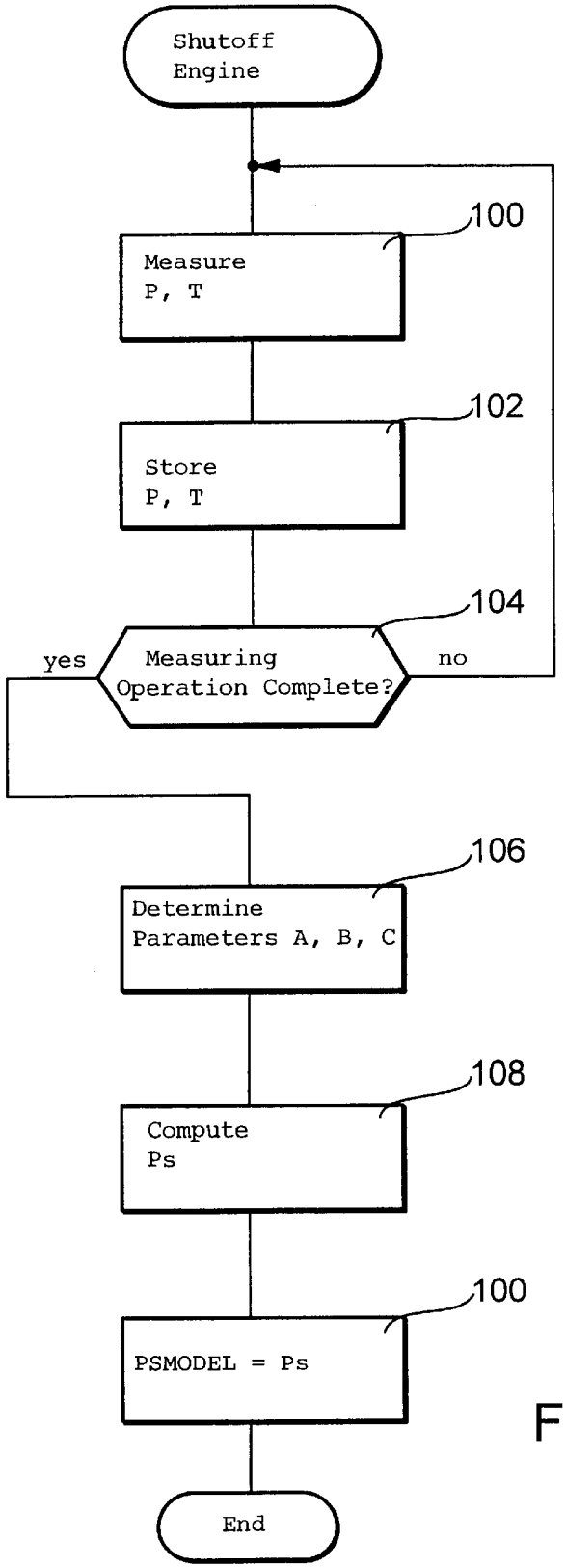
FIG. 2 is a flowchart which presents a preferred embodiment for the determination of the correction factor in dependence upon the pressure sensor signal; and, FIG. 3 is an example of a corrected characteristic line.

The program is initiated with the shutoff of the internal combustion engine. The above is caused, for example, by a corresponding signal from the ignition switch or by monitoring the engine rpm. Thereafter, the pressure P in the fuel distributor is measured cyclically and, if required, the temperature of the fuel in the fuel distributor is measured. The particular measured values are then stored in step 102. Thereafter, a check is made in step 104 as to whether a sufficient number of measured data are present. In another embodiment, a check is made as to whether a predetermined time has elapsed since shutoff of the engine or whether no significant changes of the measured pressure values can be detected. If this is not the case, then the program is repeated with step 100 so that a detection of the measured quantities of the pressure and, if required, the temperature takes place cyclically. If the measuring operation is however completed, then, in step 106, the parameters A, B and C are determined in accordance with the stored measured values of the pressure and, if required, the temperature. Thereupon, in step 108, for example on the basis of the above-mentioned vapor pressure equation, the saturation pressure Ps of the fuel is determined. This computed value is then set as model value PSMODEL (step 110) which functions in the next operating cycle of the engine to correct the quantity of fuel to be metered. The program shown in FIG. 2 is ended after the computation of the model saturation pressure.

In the above, the procedure for determining the model saturation pressure is explained with respect to the example of the vapor pressure equation of Antoine. In other applications, other relationships between saturation pressure and temperature in the fuel distributor are utilized. In the simplest case, the pressure is measured after switchoff so long until the saturation pressure is reached, that is, no significant pressure changes take place any longer.

It is understood that the foregoing description is that of the preferred embodiments of the invention and that various changes and modifications may be made thereto without departing from the spirit and scope of the invention as defined in the appended claims.

What is claimed is:

1. A method for operating an internal combustion engine having a fuel distributor, the method comprising the steps of:

determining the pressure in said fuel distributor after said engine is shut off; and, determining a signal quantity for fuel metering to said engine in the next operating cycle thereof in dependence upon said pressure.

2. The method of claim 1, wherein said next operating cycle includes the start phase of said engine.

3. The method of claim 1, the method comprising the further steps of: forming a corrective value in dependence upon said pressure and evaluating said corrective value to correct said signal quantity.

4. The method of claim 3, comprising the further steps of: determining the temperature of said fuel in said fuel distributor and considering said temperature in the formation of said corrective value.

5. The method of claim 1, the method comprising the further steps of:

after shutoff of said engine, determining measurement values for the pressure of said fuel in said fuel distributor as a function of the temperature of said fuel in said fuel distributor;

deriving the saturation pressure of the fuel on the basis of said values; and, correcting said signal quantity in dependence upon the derived saturation pressure.

6. The method of claim 1, wherein a drop in pressure in said fuel distributor takes place when said engine is switched off.

7. The method of claim 1, the method comprising the further step of reducing said pressure in said fuel distributor by doing one of the following: drawing a specific volume of said fuel from said fuel distributor by suction; or, switching in an underpressure store to said fuel distributor; or, opening the injection valves; or, utilizing an element which changes the volume of said fuel distributor when cooling down.

8. The method of claim 1, comprising the further step of determining the temperature of the fuel in said fuel distributor on the basis of an operating variable.

9. The method of claim 8, wherein said operating variable is the temperature of the cooling water of said engine.

10. The method of claim 1, wherein the signal quantity which determines the fuel metering is the injection time defined by the length of the drive pulse outputted to the injection valves.

11. An arrangement for operating an internal combustion engine having a fuel distributor, the arrangement comprising: an electronic control unit including means for determining the pressure in said fuel distributor after said engine is shut off; and, means for determining a signal quantity for fuel metering to said engine in the next operating cycle thereof in dependence upon said pressure.

* * * * *